US005593743A

United States Patent [19]

Baker

[11] Patent Number: 5,593,743

[45] Date of Patent: Jan. 14, 1997

[54] CHRISTMAS TREE SKIRT SUPPORT

[76] Inventor: Patricia M. Baker, Rte. 7, Box 587J, Mountain Home, Ark. 72653

[21] Appl. No.: 467,751

[22] Filed: Jun. 6, 1995

[51] Int. Cl.[6] ..... A47G 33/08

[52] U.S. Cl. ..... 428/18; 428/66.6; 428/131; 428/99; 47/40.5; 150/154

[58] Field of Search ..... 248/529; 47/40.5; 150/154; 428/18, 19, 99, 100, 66.6, 131

[56] References Cited

U.S. PATENT DOCUMENTS

| | | | |
|---|---|---|---|
| 104,418 | 6/1870 | Brunson | 47/40.5 |
| D. 188,192 | 6/1960 | Riveras | D29/1 |
| D. 229,758 | 11/1974 | Bartel | D29/1 B |
| D. 280,979 | 10/1985 | Groth | D11/130 |
| 2,748,516 | 6/1956 | McClusky | 41/15 |
| 2,868,255 | 2/1959 | Fancher | 150/52 |
| 3,750,731 | 8/1973 | Brimmell | 150/52 R |
| 3,802,007 | 4/1974 | Dolan, Jr. | 9/8 R |
| 3,872,906 | 3/1975 | Bolanz | 150/52 R |
| 4,581,277 | 4/1986 | Neale | 428/181 |
| 5,085,901 | 2/1992 | Johnson et al. | 428/19 |
| 5,195,715 | 3/1993 | Cone | 248/526 |
| 5,256,461 | 10/1993 | Johnson | 428/55 |
| 5,320,323 | 6/1994 | Clark, Jr. | 248/523 |
| 5,323,558 | 6/1994 | Baumler | 47/40.5 |

*Primary Examiner*—Alexander Thomas
*Attorney, Agent, or Firm*—Ray F. Cox, Jr.

[57] ABSTRACT

A Christmas tree skirt support for supporting a decorative Christmas tree skirt around the base of a Christmas tree. The preferred embodiment is constructed of plastic in a grid pattern so that the Christmas tree skirt is supported away from contact with the Christmas tree, the Christmas tree stand, and the water reservoir while allowing access through the openings in the grid to the water reservoir for refilling. The skirt support may be dissambled to one or more flat pieces for storage.

8 Claims, 2 Drawing Sheets

FIG. 3
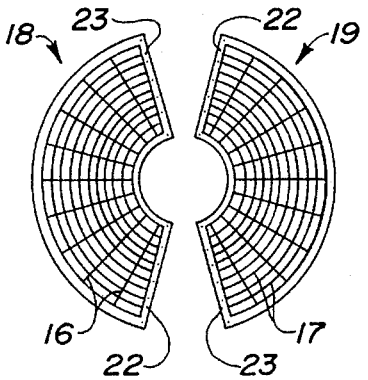
FIG. 5
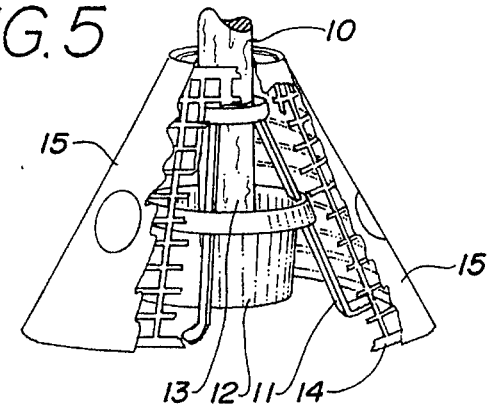
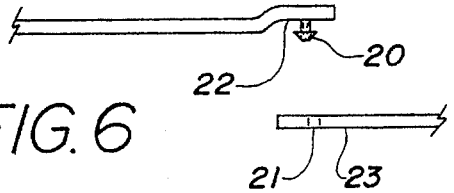
FIG. 6
FIG. 4
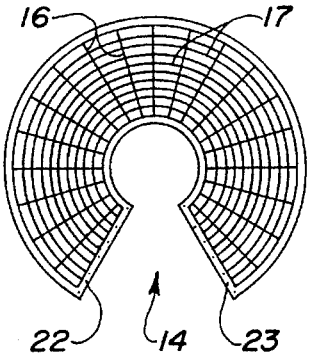
FIG. 7
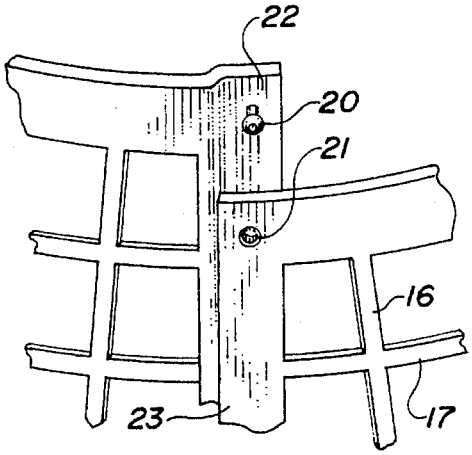
FIG. 8
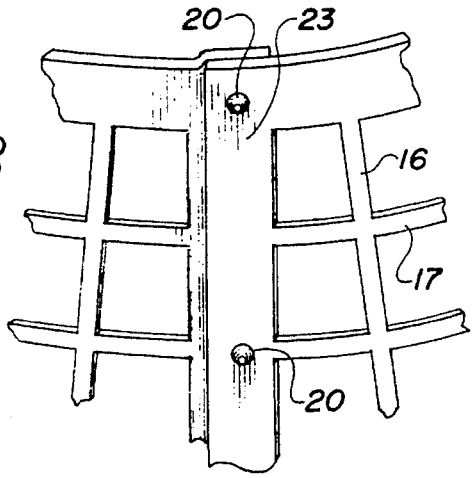

CHRISTMAS TREE SKIRT SUPPORT

BACKGROUND OF THE INVENTION

1. Field of the Invention

The present invention relates to Christmas tree decorations and in particular to a support for use with decorative Christmas tree skirts.

2. Description of the Prior Art

Christmas tree skirts are decorative fabric pieces which are placed around the base of a Christmas tree in order to hide the Christmas tree stand which holds the tree upright. In the case of cut live trees, the stand also contains a water reservoir in which the severed base of the tree rests so as to keep the tree green and well watered through the Christmas season. The Christmas tree stand is typically an unattractive metal contrivance which is less decorative than one would wish. To overcome the shortcomings of the stand, decorative skirts are employed to hide the stand and otherwise enhance the holiday decor.

Various designs of Christmas tree skirts are known. For example design, U.S. Pat. Nos. 280,979, 229,758 and 188, 192 are indicative of the general state of the art in design patents for Christmas tree skirts. Typically, Christmas tree skirts are made in a generally circular shape with a central opening to accommodate the base of the Christmas tree trunk. A slit along one side from the central opening to the outer edge allows the skirt to be draped around the Christmas tree and stand. As may be seen from the patents cited, the skirts are also covered with decorative designs.

Various other devices have been proposed for surrounding or covering up the Christmas tree stand, such as U.S. Pat. Nos. 5,323,558 and 5,256,461. Both disclose cylindrical containers and neither of these patents disclose the specific function of supporting and protecting a fabric type Christmas tree skirt.

Similarly, there are patents which disclose the function of covering or protecting the Christmas tree itself, such as U.S. Pat. Nos. 3,872,906 and 3,750,731. The latter patent is chiefly interesting in that it discloses a skirt which wraps around the base of a tree and is fastened along one side with fasteners.

Some patents disclose Christmas tree skirts made of somewhat rigid material and formed into a conical shape around the base of the tree so that the Christmas tree stand is covered. U.S. Pat. No. 3,802,007 discloses a Christmas tree support which has a rigid cone shaped skirt covering and hiding the actual stand. U.S. Pat. No. 4,581,277 discloses a Christmas tree stand skirt made of pleated material which is fastened together along one side using velcro type fasteners. (U.S. Pat. No. 104,418 shows an earlier form of this idea used for a totally different purpose; i.e., as a protector to exclude burrowing insects from attacking living trees). This type of skirt presents some problems, particularly in the case of a live tree which must be kept in a water reservoir, which in turn must be kept full. A solid cover around the Christmas tree stand prevents easy access to the water reservoir. Furthermore, the disclosed device is itself the decorative skirt and thus has limited applicability to the problem of safely and conveniently supporting a fabric skirt.

There are also patents which disclose Christmas tree skirts which are shown as being at least partially supported by portions of the tree stand. These are U.S. Pat. Nos. 2,868,255 and 2,748,516. These illustrate a situation to be avoided since Christmas tree skirts are often delicate and cannot stand the mechanical strain involved in being draped over the Christmas tree stand itself. This problem is particularly acute with antique skirts which may be highly valuable and cherished keepsakes as well. The nature of this problem may be appreciated by considering the design of typical tree stands which tend to be angular and sharp-edged and not at all suitable for supporting delicate fabrics. As illustrations of the problem, U.S. Pat. No. 5,320,323 and U.S. Pat. No. 5,195,715 depict the general state of the art in Christmas tree stands.

SUMMARY OF THE INVENTION

The present invention is a support, which may be described as a "rib cage", for supporting a skirt around the base of a Christmas tree. The invention protects the skirt from damage that might occur if the skirt were placed directly around the tree and tree stand. It also serves to keep the skirt out of contact with the water reservoir in the tree stand.

The present invention is constructed of plastic in a grid design similar to laundry baskets. The openings in the grid allow access to the water reservoir in the tree stand. The invention may be constructed in one or two pieces. The invention is essentially conical in shape. In one embodiment the invention would be able to open out flat so that it could be stored in between uses. In another embodiment, the invention would be formed in two pieces that would nest together after disassembly so as to minimize the use of storage space. In use, the device is wrapped around the base of the tree so as to cover the tree stand. It is fastened into position with a series of buttons fastening into hook or loop type fasteners or a series of mushroom-headed studs fastening snapwise into complementary openings similar to the fasteners used to adjust the size of baseball caps. In the two piece version, there are two sets of these fasteners.

In the one piece embodiment, the invention opens out flat when it is unfastened, but it assumes a conical shape around the base of the Christmas tree. This version of the invention is constructed of flexible material which is bendable to assume a conical shape around the Christmas tree and stand, but is sufficiently flexible to flatten out when unfastened. In the two piece version, the separate parts may also open out flat, but may be designed to retain a three dimensional shape which nests together for storage. It should be understood that shapes other than conical are considered to fall within the scope of the present invention. For example, rounded shapes such as hemispherical may be employed. In either version, the material is sufficiently rigid to support the weight of the Christmas tree skirt. Polyethylene is an acceptable material, although the present invention is not limited thereto.

The present invention is formed in a grid of ribs which provides adequate structural rigidity and also provides openings for access to the water reservoir without unduly disturbing the skirt.

It is therefore an object of the present invention to provide for a support for a Christmas tree skirt which supports the skirt away from contact with the Christmas tree stand or water reservoir.

It is a further object of the present invention to provide for a Christmas tree skirt which allows access to a water reservoir in the Christmas tree stand.

It is an additional object of the present invention to provide for a Christmas tree skirt support which is easily assembled and disassembled and which is reducible to a minimum size for ease and efficiency in storage.

Other objects and advantages of the present invention will be made apparent from a consideration of the following detailed description of the preferred embodiments in conjunction with the appended drawings as described below.

BRIEF DESCRIPTION OF THE DRAWINGS

FIG. 3 is a plan view of the Christmas tree skirt support of the present invention disassembled and flattened for storage. The embodiment depicted is separable into two pieces.

FIG. 4 is a plan view of an alternative embodiment of the Christmas tree skirt support of the present invention disassembled and flattened for storage. The alternative embodiment is in one piece.

FIG. 5 is a partial perspective view showing the Christmas tree skirt support of the present invention assembled in position around the base of a Christmas tree and Christmas tree stand with a Christmas tree skirt in position thereon. A portion of the Christmas tree skirt and skirt support are broken away to show the Christmas tree stand and the base of the Christmas tree.

FIG. 6 is a partial plan view detailing the closure means.

FIGS. 7 and 8 are partial perspective views detailing the closure means. FIG. 7 is disassembled and FIG. 8 is assembled.

DETAILED DESCRIPTION OF THE PREFERRED EMBODIMENTS

Figure 1:
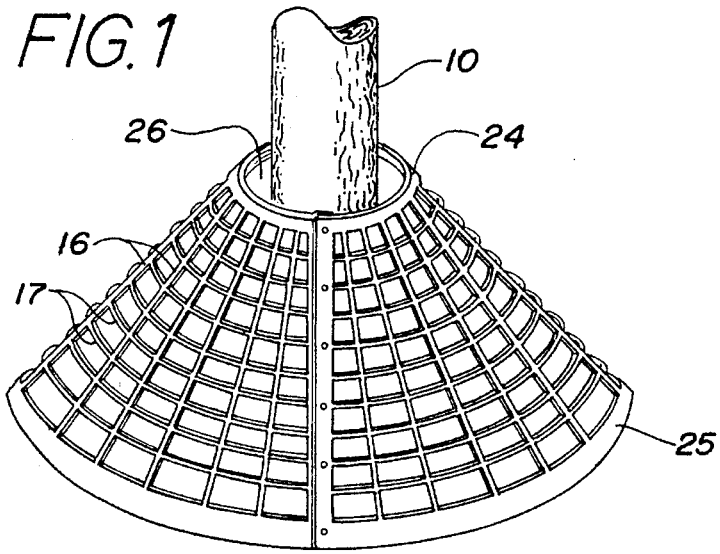
FIG. 1 is a perspective view of the Christmas tree skirt support of the present invention as deployed around the base of a Christmas tree.

The present invention is a support for supporting a skirt around the base of a Christmas tree as depicted in FIG. 5. A Christmas tree 10 is placed in a Christmas tree stand 11 which serves to hold the Christmas tree 10 upright. In addition, in the case of a live cut tree, water must be supplied to the Christmas tree 10 in order to maintain it in good condition throughout the holiday season. The Christmas tree stand 11 therefor incorporates a water reservoir 12 which holds the base 13 of the Christmas tree 10 securely and supplies water through the exposed cut surface of the Christmas tree's trunk. The Christmas tree skirt support 14 of the present invention is deployed around the base 13 of the Christmas tree 10 so as to surround the base 13 and cover the Christmas tree stand 11. A decorative Christmas tree skirt 15 is placed around the Christmas tree skirt support 14 so that the Christmas tree skirt 15 is supported by the Christmas tree skirt support 14. The skirt support 14 thereby protects the skirt 15 from damage that might occur if the skirt 15 were placed directly around the tree 10 and tree stand 11. The skirt support 14 also serves to keep the skirt 15 out of contact with the water reservoir 12 in the tree stand 11.

As may be seen with reference to FIG. 4, the skirt support 14 is constructed of radial ribs 16 and circumferential ribs 17 in a grid design similar to laundry baskets. The openings in the grid formed by the ribs 16, 17 allow access to the water reservoir 12 in the tree stand 11. Various other arrangements of ribs would be acceptable and considered to fall within the scope of the present invention, for example, circular, oval or hexagonal grid openings would provide acceptable structural rigidity and access the water reservoir 12.

The skirt support 14 may be constructed in one or two pieces. In the embodiment of FIG. 4 the skirt support 14 opens out flat for easy storage between uses. In the embodiment of FIG. 3, the skirt support 14 is formed in two pieces 18, 19 that nest together after disassembly so as to minimize the use of storage space.

Figure 2:
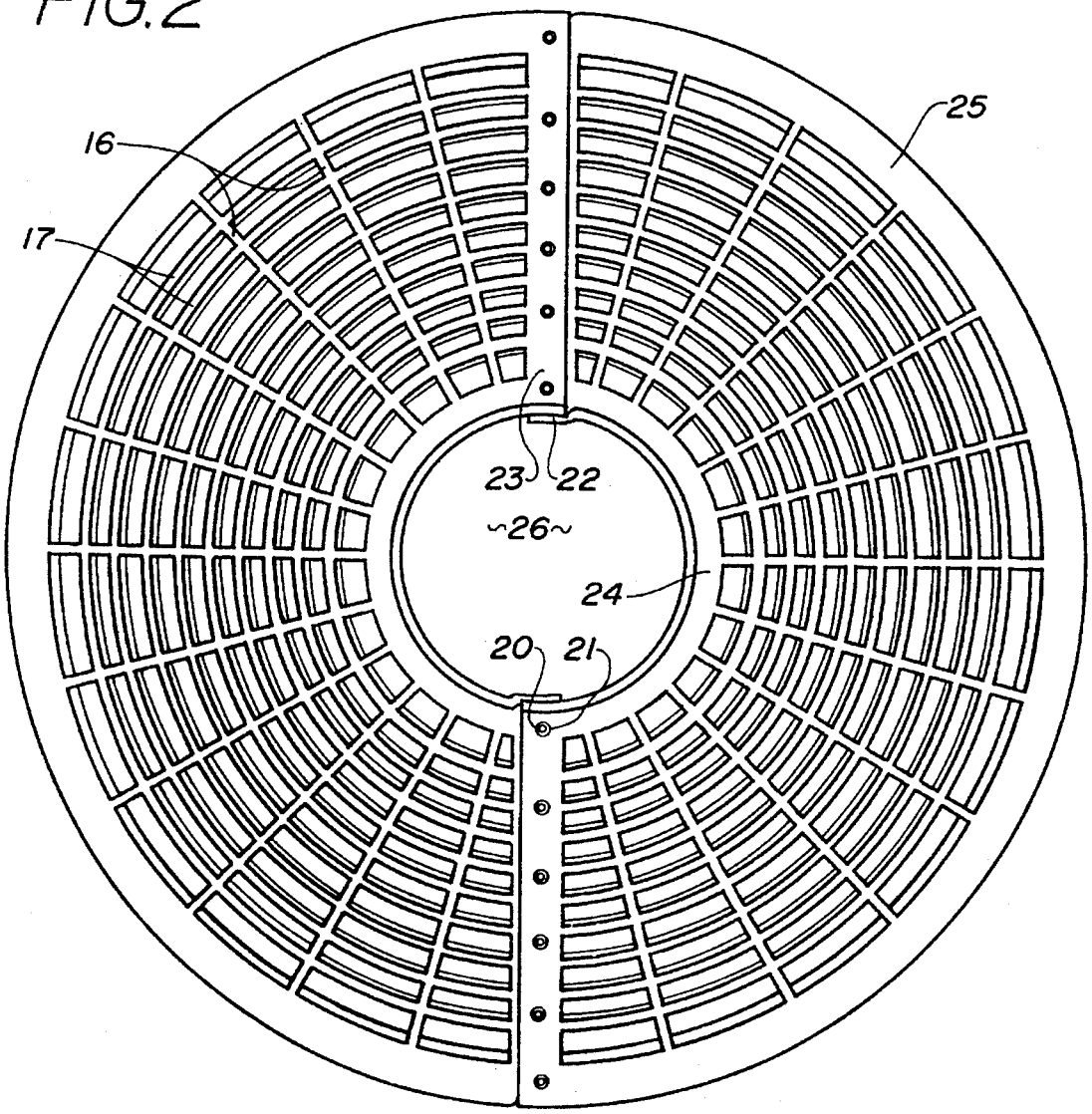
FIG. 2 is a plan view of the Christmas tree skirt support of the present invention as deployed for use. The Christmas tree is removed for clarity.

In order to assemble the skirt support 14, it is wrapped around the base 13 of the Christmas tree 10 so as to cover the tree stand 11. In the preferred embodiment as shown in FIGS. 6, 7 and 8, the skirt support 14 is fastened into its use position with a series of mushroom-headed studs 20 fastening snapwise into complementary openings 21 similar to the fasteners used to adjust the size of baseball caps. The studs 20 are arrayed along an inner terminal strip 22 which is a widened, thickened version of the radial ribs 16. Likewise, the openings 21 are arrayed along a similar outer terminal strip 23. The terminal strips 22, 23 may be used to provide additional structural rigidity if desired. As shown in FIGS. 1 and 2, a top reinforcing strip 24 and a bottom reinforcing strip 25 may also be employed for greater rigidity of the assembled device. Again with reference to FIGS. 7 and 8 fastening means may alternatively comprise a series of buttons fastening into hook or loop type fasteners or various other fastening means that would be apparent to one skilled in the art. In the two piece version, there are two sets of fasteners and terminal strips.

In the one piece embodiment shown in FIG. 4, the skirt support 14 opens out flat when it is unfastened, but it assumes a conical shape around the base 13 of the Christmas tree 10. This version of the invention is constructed of flexible material which is bendable to assume a conical shape around the Christmas tree 10 and stand 11, but is sufficiently flexible to flatten out when unfastened. The unassembled, flattened shape is shown in FIG. 4, while the conical assembled shape is shown in FIG. 1. In the two piece version, the separate parts may also open out flat as shown in FIG. 3, but may be designed to retain a three dimensional shape which nests together for storage. The conical assembled shape of the two piece version is shown in FIG. 2. It should be understood that shapes other than conical are considered to fall within the scope of the present invention. For example, rounded shapes such as hemispherical may be employed. In either version, the material is sufficiently rigid to support the weight of the Christmas tree skirt. Polyethylene is an acceptable material, although the present invention is not limited thereto.

The present invention has been described with reference to certain preferred and alternative embodiments which are exemplary only and not limiting. Various modifications would be apparent to one skilled in the art and would not depart from the full scope of the present invention as set forth in the appended claims.

What is claimed is:

1. In combination with a Christmas tree, a Christmas tree stand for supporting the Christmas tree, and a Christmas tree skirt for covering the Christmas tree stand, a Christmas tree skirt support, comprising:

a grid of ribs surrounding the Christmas tree at its base and extending over the Christmas tree stand; and a Christmas tree skirt supported around the Christmas tree at its base on said grid of ribs and prevented from contact with the Christmas tree stand by said grid of ribs.

2. The Christmas tree skirt support of claim 1, wherein the Christmas tree stand incorporates a water reservoir and said grid defines a plurality of openings for access to the water reservoir.

3. The Christmas tree skirt support of claim 2 wherein said Christmas tree skirt support is essentially a truncated cone.

4. The Christmas tree skirt support of claim 3 further comprising fastening means for disassembling said Christmas tree skirt support into an essentially flat shape for storage and assembling said Christmas tree skirt support into an essentially truncated cone shape in use.

5. The Christmas tree skirt support of claim 4 further comprising a plurality of fastening means for disassembling said Christmas tree skirt support into a plurality of flat pieces for storage.

6. The Christmas tree skirt support of claim 4 wherein said grid comprises a plurality of radial ribs and a plurality of circumferential ribs.

7. The Christmas tree skirt support of claim 6 wherein said Christmas tree skirt support essentially comprises flexible plastic material capable of opening into a flat shape for storage and sufficiently rigid when assembled to support the Christmas tree skirt.

8. The Christmas tree skirt support of claim 7 wherein said fastening means comprises a pair of radial terminal strips, one of said radial terminal strips having a plurality of mushroom-headed studs and the other of said radial terminal strips having a plurality of complementary fastening holes to snapwise receive said mushroom-headed studs whereby said Christmas tree skirt support may be disassembled into an essentially flat shape for storage and assembled into an essentially truncated cone shape in use.

* * * * *